US011611136B2

(12) United States Patent
Lin et al.

(10) Patent No.: US 11,611,136 B2
(45) Date of Patent: Mar. 21, 2023

(54) POWER DIVIDER/COMBINER

(71) Applicant: National Chi Nan University, Nantou (TW)

(72) Inventors: Yo-Sheng Lin, Nantou (TW); Kai-Siang Lan, Nantou (TW)

(73) Assignee: National Chi Nan University, Nantou (TW)

( * ) Notice: Subject to any disclaimer, the term of this patent is extended or adjusted under 35 U.S.C. 154(b) by 96 days.

(21) Appl. No.: 17/371,264

(22) Filed: Jul. 9, 2021

(65) Prior Publication Data

US 2022/0311119 A1 Sep. 29, 2022

(30) Foreign Application Priority Data

Mar. 24, 2021 (TW) ..... 110110662

(51) Int. Cl.
*H01P 5/18* (2006.01)
*H01P 5/19* (2006.01)
*H01P 3/08* (2006.01)

(52) U.S. Cl.
CPC ..... *H01P 5/19* (2013.01); *H01P 3/08* (2013.01); *H01P 5/185* (2013.01)

(58) Field of Classification Search
CPC ..... H01P 5/12; H01P 5/16; H01P 5/18; H01P 5/19; H01P 5/184; H01P 5/185; H01P 3/08; H01P 3/003
See application file for complete search history.

(56) References Cited

U.S. PATENT DOCUMENTS

| | | | | |
|---|---|---|---|---|
| 5,363,071 | A * | 11/1994 | Schwent | H01P 5/04 333/17.1 |
| 6,121,853 | A * | 9/2000 | London | H01P 5/12 333/127 |
| 10,714,806 | B2 * | 7/2020 | Ootsuka | H01P 1/24 |
| 11,205,830 | B1 * | 12/2021 | Lin | H01P 3/003 |
| 2011/0148544 | A1 * | 6/2011 | Hirai | H01P 5/185 333/116 |
| 2013/0141184 | A1 * | 6/2013 | Tamaru | H01P 5/18 333/112 |

* cited by examiner

*Primary Examiner* — Stephen E. Jones

(74) *Attorney, Agent, or Firm* — Thomas | Horstemeyer, LLP

(57) ABSTRACT

A power divider/combiner includes a first transmission line that includes a first part and a second part, and a second transmission line and a third transmission line that are electromagnetically coupled with the first transmission line. The first part, the second part, the second transmission line and the third transmission line are each of a particular length. The first part, the second transmission line and the third transmission line are respectively connected to a first port, a second port and a third port for inputting/outputting signals having a target wavelength equal to four times the particular length.

12 Claims, 9 Drawing Sheets

POWER DIVIDER/COMBINER

CROSS-REFERENCE TO RELATED APPLICATION

This application claims priority of Taiwanese Invention Patent Application No. 110110662, filed on Mar. 24, 2021.

FIELD

The disclosure relates to a power divider/combiner, and more particularly to a power divider/combiner including plural transmission lines.

BACKGROUND

A conventional Wilkinson power divider/combiner includes two quarter-wave (λ/4) transmission lines that each have a length equal to one-quarter wavelength of an input signal of the Wilkinson power divider/combiner. The two transmission lines are spaced apart and diverge from each other in order to prevent electromagnetic coupling. The two diverged transmission lines of the Wilkinson power divider/combiner result in larger device area and higher production cost.

SUMMARY

Therefore, an object of the disclosure is to provide a power divider/combiner that can alleviate at least one of the drawbacks of the prior art.

According to one aspect of the disclosure, the power divider/combiner includes a first transmission line, a second transmission line and a third transmission line. The first transmission line includes a first part and a second part that are of a same particular length. The first part and the second part each have a first end and a second end, wherein the second end of the first part is connected to the first end of the second part, the first end of the first part is connected to a first port, and the second end of the second part is grounded. The second transmission line and the third transmission line are both of the particular length, and are both disposed in the vicinity of the first transmission line without contacting the first transmission line, so that the second transmission line and the third transmission line are electromagnetically coupled with the first transmission line. The second transmission line and the third transmission line each have a first end and a second end, wherein the second end of the second transmission line is connected to a second port, and the second end of the third transmission line is connected to a third port. The first transmission line, the second transmission line and the third transmission line are configured such that when an input signal that has a target wavelength equal to four times the particular length is received at the first port, a pair of output signals that are in-phase with each other and that each have the target wavelength are outputted respectively at the second port and the third port. The first transmission line, the second transmission line and the third transmission line are also configured such that when a pair of input signals that are in-phase with each other and that each have the target wavelength are received respectively at the second port and the third port, an output signal that has the target wavelength is outputted at the first port.

BRIEF DESCRIPTION OF THE DRAWINGS

Other features and advantages of the disclosure will become apparent in the following detailed description of the embodiment (s) with reference to the accompanying drawings, of which.

DETAILED DESCRIPTION

Figure 1:
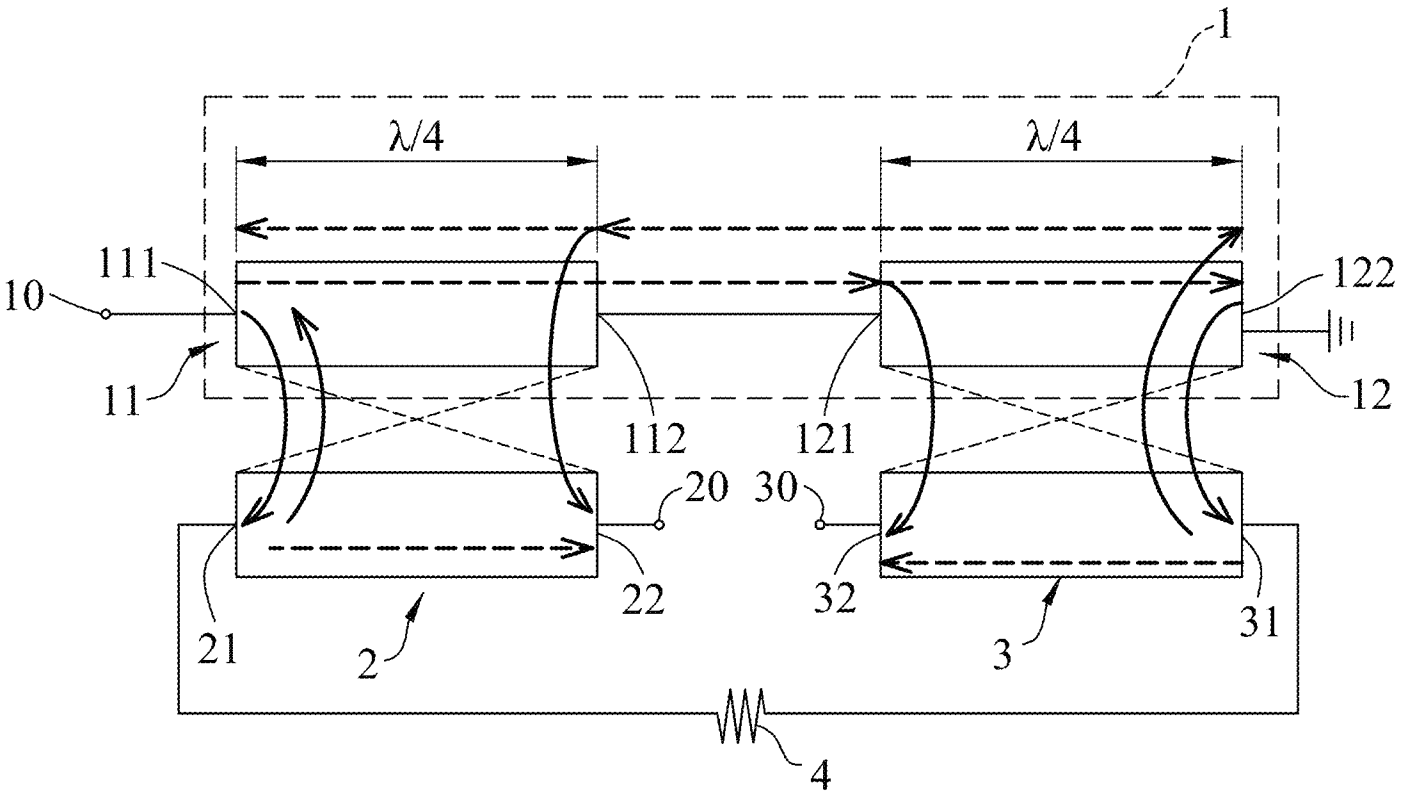
FIG. 1 is a circuit diagram that exemplarily illustrates a power divider/combiner according to an embodiment of the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

FIG. 1 exemplarily illustrates a power divider/combiner according to an embodiment of the disclosure. Referring to FIG. 1, the power divider/combiner includes a first transmission line 1, a second transmission line 2, a third transmission line 3 and a resistor 4.

The first transmission line 1 includes a first part 11 and a second part 12 that are of a same particular length (λ/4) which equals one quarter of a target wavelength (λ). The first part 11 has a first end 111 and a second end 112. The second part 12 has a first end 121 and a second end 122. The first end 111 of the first part 11 is connected to a first port 10 for receiving or outputting an electric signal that has the target wavelength. The second end 112 of the first part 11 is connected to the first end 121 of the second part 12, so that the first part 11 may transmit/receive signals to/from the second part 12. The second end 122 of the second part 12 is grounded.

The second transmission line 2 and the third transmission line 3 are each of the particular length of λ/4. The second transmission line 2 and the third transmission line 3 are disposed in the vicinity of the first transmission line 1 without contacting the first transmission line 1, so that the second transmission line 2 and the third transmission line 3 are each electromagnetically coupled to the first transmission line 1. In the embodiment shown in FIG. 1, the second transmission line 2 and the third transmission line 3 are disposed in the vicinity of the first part 11 and the second part 12 of the first transmission line 1, respectively, so that the second transmission line 2 and the third transmission line 3 are electromagnetically coupled to the first part 11 and the second part 12, respectively, thereby forming two back-to-back coupled-line couplers (CLCs) as indicated by the crossed dash-lines in FIG. 1 that are between the first part 11 and the second transmission line 2 and between the second part 12 and the third transmission line 3.

The second transmission line 2 has a first end 21 and a second end 22. The third transmission line 3 has a first end 31 and a second end 32. In the embodiment shown in FIG. 1, the first end 21 and the second end 22 of the second transmission line 2 are disposed near the first end 111 and the second end 112 of the first part 11 of the first transmission line 1, respectively, and the first end 31 and the second end 32 of the third transmission line 3 are disposed near the second end 122 and the first end 121 of the second part 12 of the first transmission line 1, respectively. The first end 21 of the second transmission line 2 and the first end 31 of the third transmission line 3 are connected to the resistor 4. The second end 22 of the second transmission line 2 is connected to a second port 20. The second end 32 of the third transmission line 3 is connected to a third port 30. The second port 20 and the third port 30 are capable of receiving or outputting a pair of electric signals that are in-phase with each other and that each have the target wavelength of λ. According to some embodiments of the disclosure, the resistor 4 connected between the second transmission line 2 and the third transmission line 3 has an electrical resistance that is between 25Ω and 100Ω. The resistor 4 helps to increase isolation between the second end 22 of the second transmission line 2 and the second end 32 of the third transmission line 3. Specifically, the resistor 4 helps to improve scattering parameters (S-parameters) of the power combiner/divider, specifically, a scattering parameter $S_{32}$ related to isolation between the second transmission line 2 and the third transmission line 3, an S-parameter $S_{22}$, related to an input reflection coefficient of the second transmission line 2, and an S-parameter $S_{33}$ related to an input reflection coefficient of the third transmission line 3, so that the three S-parameters have values close to an ideal value of zero. Due to the symmetry of the power combiner/divider, the middle point of the resistor 4 is equivalent to open circuit in the even-mode. Therefore, the first end 21 of the second transmission line 2 and the first end 31 of the third transmission line 3 may be regarded as open terminals.

When an input signal that has the target wavelength of λ is received at the first port 10, the power divider/combiner as shown in FIG. 1 functions as a power divider, and outputs a pair of output signals respectively at the second port 20 and the third port 30. The two output signals are in-phase with each other, and each has the target wavelength of λ and a power that is half the power of the input signal.

When a pair of input signals that are in-phase with each other, that each have the target wavelength of λ, and that has a same power are received respectively at the second port 20 and the third port 30, the power divider/combiner as shown in FIG. 1 functions as a power combiner, and outputs an output signal at the first port 10. The output signal outputted at the first port 10 has the target wavelength of λ and a power that is twice the power of each of the input signals received at the second port 20 and the third port 30.

Signal flows inside the power divider/combiner when functioning as a power divider are exemplarily illustrated in FIG. 1, wherein dash-line arrows represent signal flows via transmission or conducting lines, and solid-line arrows represent signal flows via electromagnetic coupling. Specifically, when an input signal that is received at the first port 10 reaches the first end 111 of the first part 11 of the first transmission line 1, a portion of the input signal (referred to as "first coupled signal" hereinafter) is coupled to the first end 21 of the second transmission line 2, and the rest of the input signal (referred to as "first transmitted signal" hereinafter) is transmitted through the first part 11 to the second end 112 of the first part 11 and further to the first end 121 of the second part 12 of the first transmission line 1. A portion of the first coupled signal is transmitted through the second transmission line 2 to the second end 22 and forms a component of a first output signal that is to be outputted at the second node 20, and the rest of the first coupled signal is reflected toward the first end 111 of the first part 11 and forms a first return signal at the first end 111. When the first transmitted signal reaches the first end 121 of the second part 12, a portion of the first transmitted signal (referred to as "second coupled signal") is coupled to the second end 32 of the third transmission line 3 and forms a component of a second output signal that is to be outputted at the third node 30, and the rest of the first transmitted signal (referred to as "second transmitted signal" hereinafter) is transmitted through the second part 12 to the second end 122 of the second part 12. When the second transmitted signal reaches the second end 122 of the second part 12, a portion of the second transmitted signal (referred to as "third coupled signal" hereinafter) is coupled to the first end 31 of the third transmission line 3, and the rest of the second transmitted signal (referred to as "third transmitted signal" hereinafter) is reflected and transmitted through the second part 12 to the first end 121 of the second part 12 and further to the second end 112 of the first part 11. A portion of the third coupled signal is transmitted through the third transmission line 3 to the second end 32 and forms another component of the second output signal to be outputted at the third node 30, and the rest of the third coupled signal is reflected toward the second node 122 of the second part 12 and is incorporated into the third transmitted signal transmitted to the first part 11. When the third transmitted signal reaches the second end 112 of the first part 11, a portion of the third transmitted signal is coupled to the second end 22 of the second transmission line 2 and forms another component of the first output signal to be outputted at the second node 20, and the rest of the third transmitted signal is transmitted through the first part 11 to the first end 111 of the first part 11 and forms a second return signal at the first end 111. Because both the first part 11 and the second part 12 are of the length of λ/4, the second return signal at the first end 111 has an amplitude the same as an amplitude of the first return signal, and is 180° out of phase with the first return signal. Therefore, the first and second return signals are cancelled, and no signal is outputted at the first end 111 or the first port 10. In other words, the disclosed power divider has an S-parameter $S_{11}$ at the first node 10 that equals zero.

Based on reciprocity theorem for microwave passive components, the operation principle of the disclosed power divider/combiner when functioning as a power combiner can be easily perceived, and is not described here.

Figure 2:
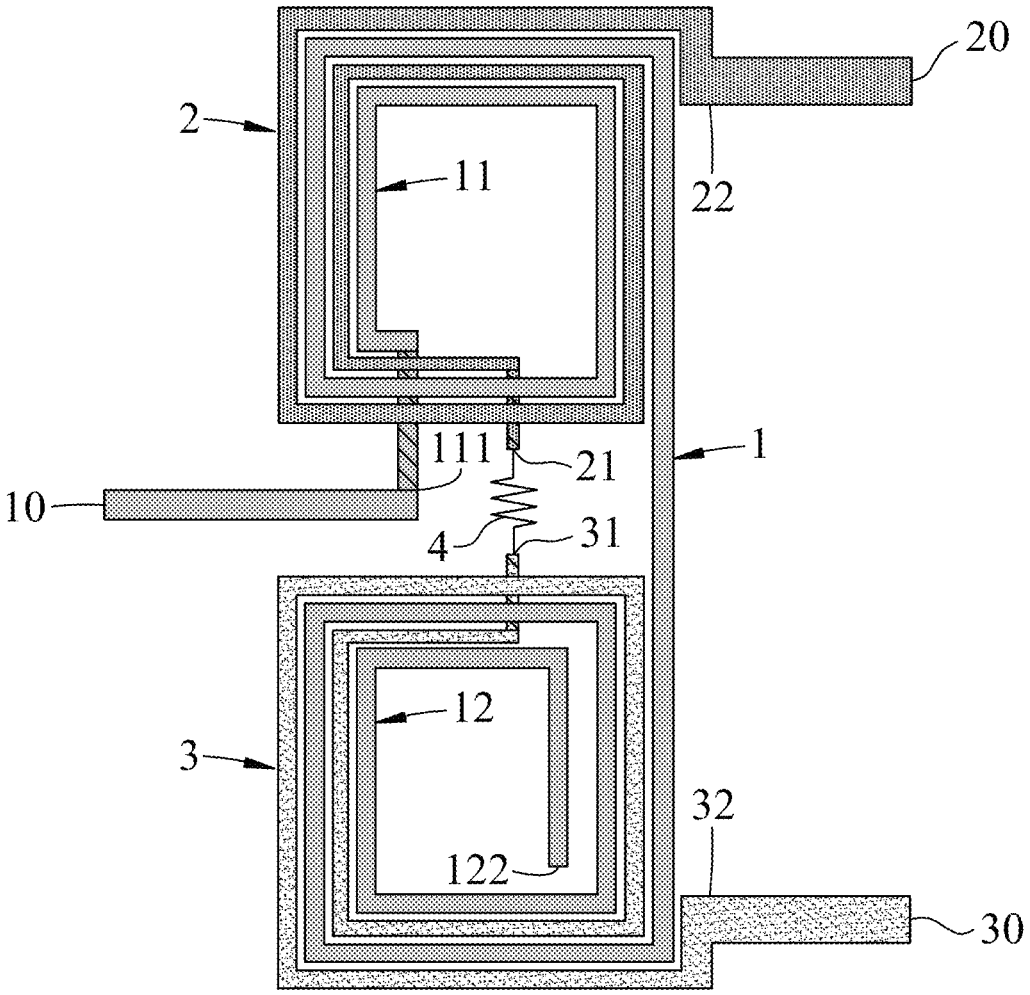
FIG. 2 is a schematic diagram that exemplarily illustrates a layout of the power divider/combiner according to an embodiment of the disclosure.

FIG. 2 exemplarily Illustrates a layout of the power divider/combiner according to an embodiment of the disclosure that utilizes 0.18 μm CMOS (complementary metal-oxide-semiconductor) technology, wherein segments of conductors that are filled with slashes are to be positioned at a layer that is different from a layer where segments of conductors that are not filled with slashes reside. In the implementation shown in FIG. 2, the first part 11 and the second part 12 of the first transmission line 1 are of a same and uniform width. The widths of the second transmission line 2 and the third transmission line 3 are gradually narrower from the second end 22 to the first end 21 and from the second end 32 to the first end 31, respectively. As can be seen in FIG. 2, the first part 11 of the first transmission line 1, the second part 12 of the first transmission line 1, the second transmission line 2 and the third transmission line 3 are each arranged generally as a square spiral, with the second transmission line 2 substantially uniformly spaced from the first part 11, and the third transmission line 3 substantially uniformly spaced from the second part 12. Regarding the electromagnetic field of each of the second transmission line 2 and the third transmission line 3 that is the strongest at the center and gradually attenuates outward, the tapering width of each of the second transmission line 2 and the third transmission line 3 that is smaller at the center region of the second/third transmission line 2, 3 is beneficial in reducing an area occupied by metal conductors that are accountable for power loss, thereby reducing overall power loss of the power divider/combiner. In addition, the tapering widths of the second transmission line 2 and the third transmission line 3 offer more degrees of freedom in designing the power divider/combiner.

In an embodiment that utilizes the layout of FIG. 2 and that is designed for 33 GHz operation (that is, being operated with input signals having the frequency of 33 GHz), the width of each of the first part 11 and the second part 12 is 5 μm, the width of the second transmission line 2 is 8 μm at the second end 22 and 3 μm at the first end 21, the width of the third transmission line 3 is 8 μm at the second end 32 and 3 μm at the first end 31, the intervals between the second transmission line 2 and the first part 11 and between the third transmission line 3 and the second part 12 are 2 μm, and the electrical resistance of the resistor 4 is 100Ω. The power divider/combiner of said embodiment has a width of 109 μm and a length of 243 μm, which yield an area of 0.026 $mm^2$, which is significantly small in comparison with a conventional Wilkinson power divider/combiner that has an area of 0.116 $mm^2$.

Figure 3:
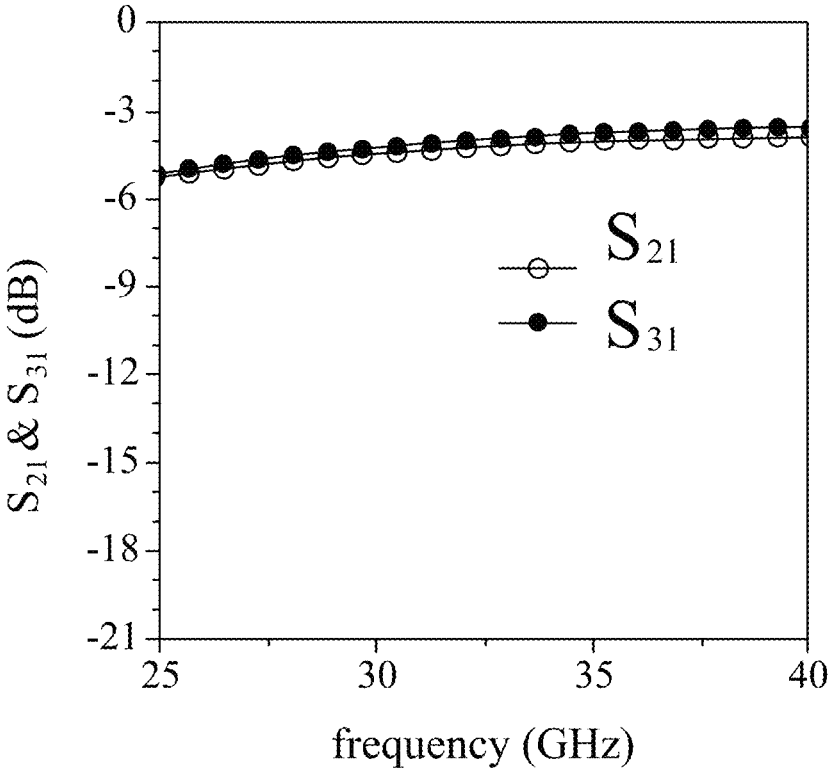
FIG. 3 is a chart that exemplarily illustrates two scattering parameters (S-parameters) associated with the power divider/combiner according to an embodiment of the disclosure.
Figure 4:
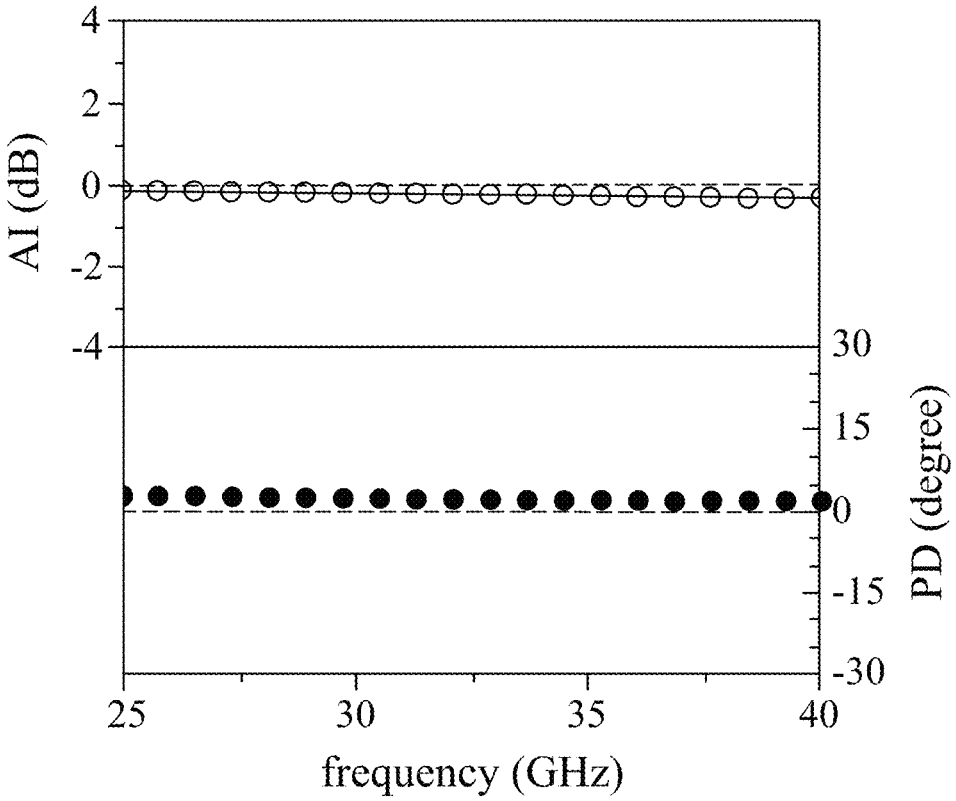
FIG. 4 is a chart that exemplarily illustrates amplitude imbalance and phase difference between the two S-parameters according to an embodiment of the disclosure.

FIG. 3 is a chart that exemplarily illustrates an S-parameter $S_{21}$ and an S-parameter $S_{31}$ (in dB) that are simulated with respect to the power divider/combiner shown in FIG. 2 when operated at 25 GHz to 40 GHz, wherein the S-parameter is related to signals from the first port 10 to the second port 20 (i.e., from the first end 111 of the first part 11 of the first transmission line 1 to the second end 22 of the second transmission line 2), and the S-parameter $S_{31}$ is related to signals from the first port 10 to the third port 30 (i.e., from the first end 111 of the first part 11 to the second end 32 of the third transmission line 3). It can be seen that the values of the S-parameters $S_{21}$ and $S_{31}$ in the chart are very close to an ideal value of −3 dB, which means that the disclosed power divider/combiner does not suffer from significant power loss. Amplitude imbalance (AI) and phase difference (PD) between the S-parameters $S_{21}$ and $S_{31}$ are shown in FIG. 4, wherein AI=$S_{21}$(dB)−$S_{31}$(dB), and PD=$S_{21}$(degree)−$S_{31}$(degree). It can be seen that the values of AI thus derived are close to an ideal value of 0 dB, and the values of PD thus derived are close to an idle value of 0'.

Figure 5:
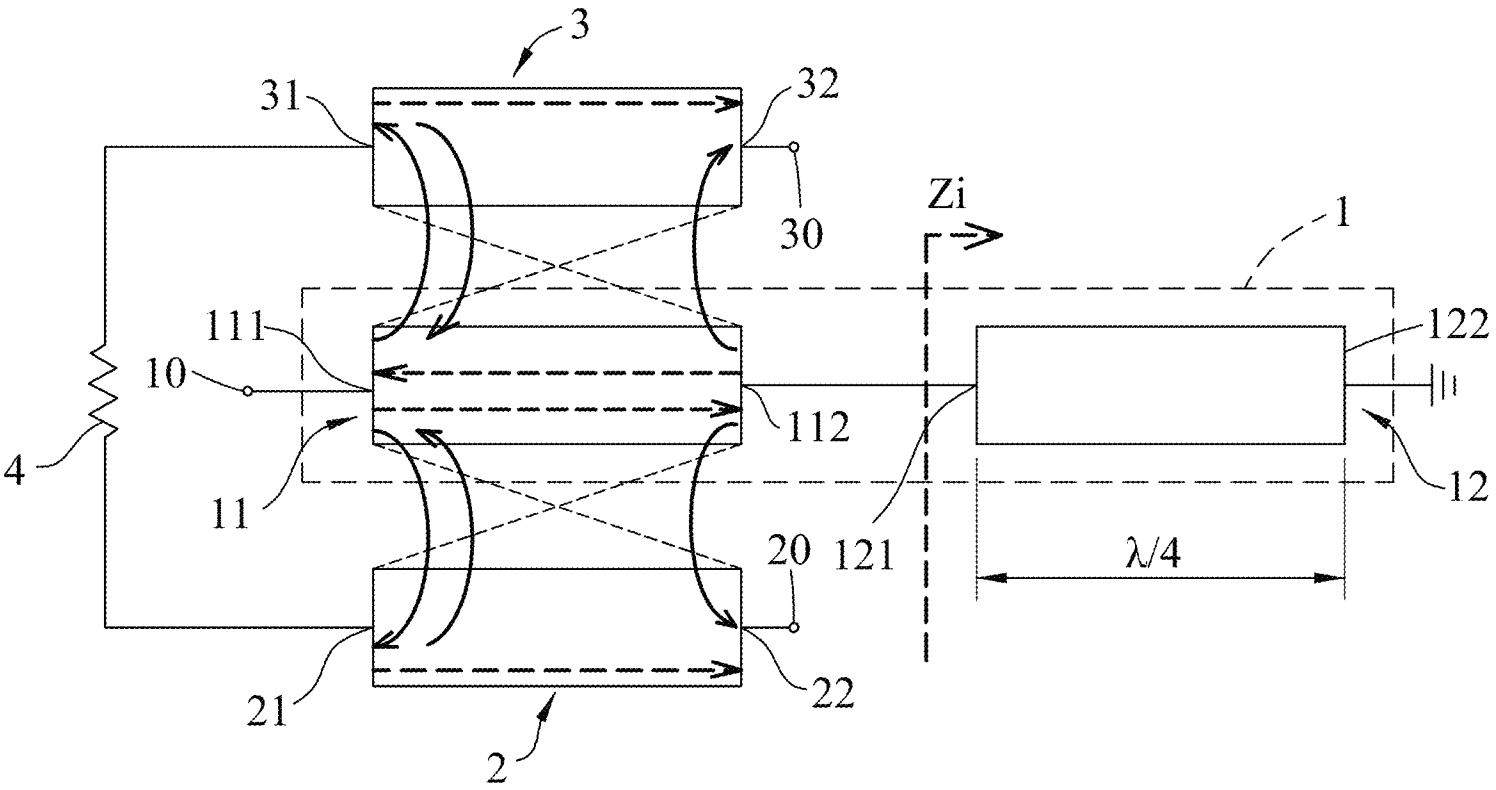
FIG. 5 is a circuit diagram that exemplarily illustrates another power divider/combiner according to an embodiment of the disclosure.

FIG. 5 exemplarily illustrates another power divider/combiner according to an embodiment of the disclosure. The power divider/combiner shown in FIG. 5 (referred to as "second power divider/combiner" hereinafter) is an alteration of the power divider/combiner shown in FIG. 1 (referred to as "first power divider/combiner" hereinafter).

Figure 6:
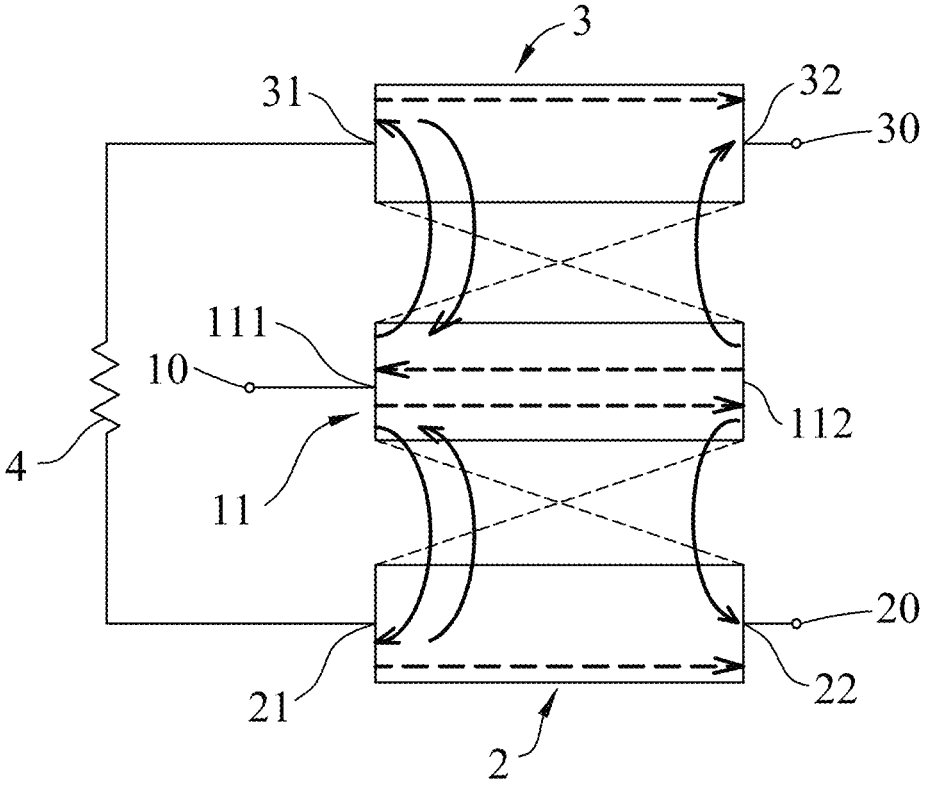
FIG. 6 is a circuit diagram illustrating an equivalent circuit for the circuit in FIG. 5.

Similar to the first power divider/combiner, the second power divider/combiner includes the first transmission line 1 including the first part 11 and the second part 12 that are of the length of λ/4, the second transmission line 2 of the length of λ/4 and disposed in the vicinity of the first transmission line 1, the third transmission line 3 of the length of λ/4 and disposed in the vicinity of the first transmission line 1, and the resistor 4 connected between the second transmission line 2 and the third transmission line 3. The second power divider/combiner differs from the first power divider/combiner in that, in the second power divider/combiner, the third transmission line 3 is disposed in the vicinity of the first part 11 (rather than the second part 12 as in the first power divider/combiner) of the first transmission line 1. Specifically, in the second power divider/combiner, the second transmission line 2 and the third transmission line 3 are both disposed in the vicinity of the first part 11, so that the second transmission line 2 and the third transmission line 3 are both electromagnetically coupled with the first part 11, thereby forming two back-to-back CLCs as indicated by the crossed dash-lines in FIG. 5 that are between the first part 11 and the second transmission line 2 and between the first part 11 and the third transmission line 3. The two CLCs of the second power divider/combiner share the first part 11 of the first transmission line 1. The second transmission line 2 and the third transmission line 3 are each substantially uniformly spaced from the first part 11. Both of the first end 21 of the second transmission line 2 and the first end 31 of the third transmission line 3 are disposed near the first end 111 of the first part 11. Both of the second end 22 of the second transmission line 2 and the second end 32 of the third transmission line 3 are disposed near the second end 112 of the first part 11. In the second power divider/combiner, because the second end 122 of the second part 12 of the first transmission line 1 is connected to a short load (i.e., being grounded), and because the length of the second part 12 is λ/4, the input impedance Z, looking into the second part 12 is infinite due to impedance inversion. Therefore, a circuit as shown in FIG. 6 that is an equivalent circuit of the circuit in FIG. 5 can be derived, wherein the second end 112 of the first part 11 of the first transmission line 1 is shown as an open terminal.

FIG. 5 also shows signal flows inside the second power divider/combiner when functioning as a power divider, wherein dash-line arrows represent signal flows via transmission or conducting lines, and solid-line arrows represent signal flows via electromagnetic coupling, as described above with respect to FIG. 1. Details of the signal flows shown in FIG. 5 can be easily perceived based on basic electromagnetic coupling and reflection phenomena for transmission lines, and therefore are not described here.

Figure 7:
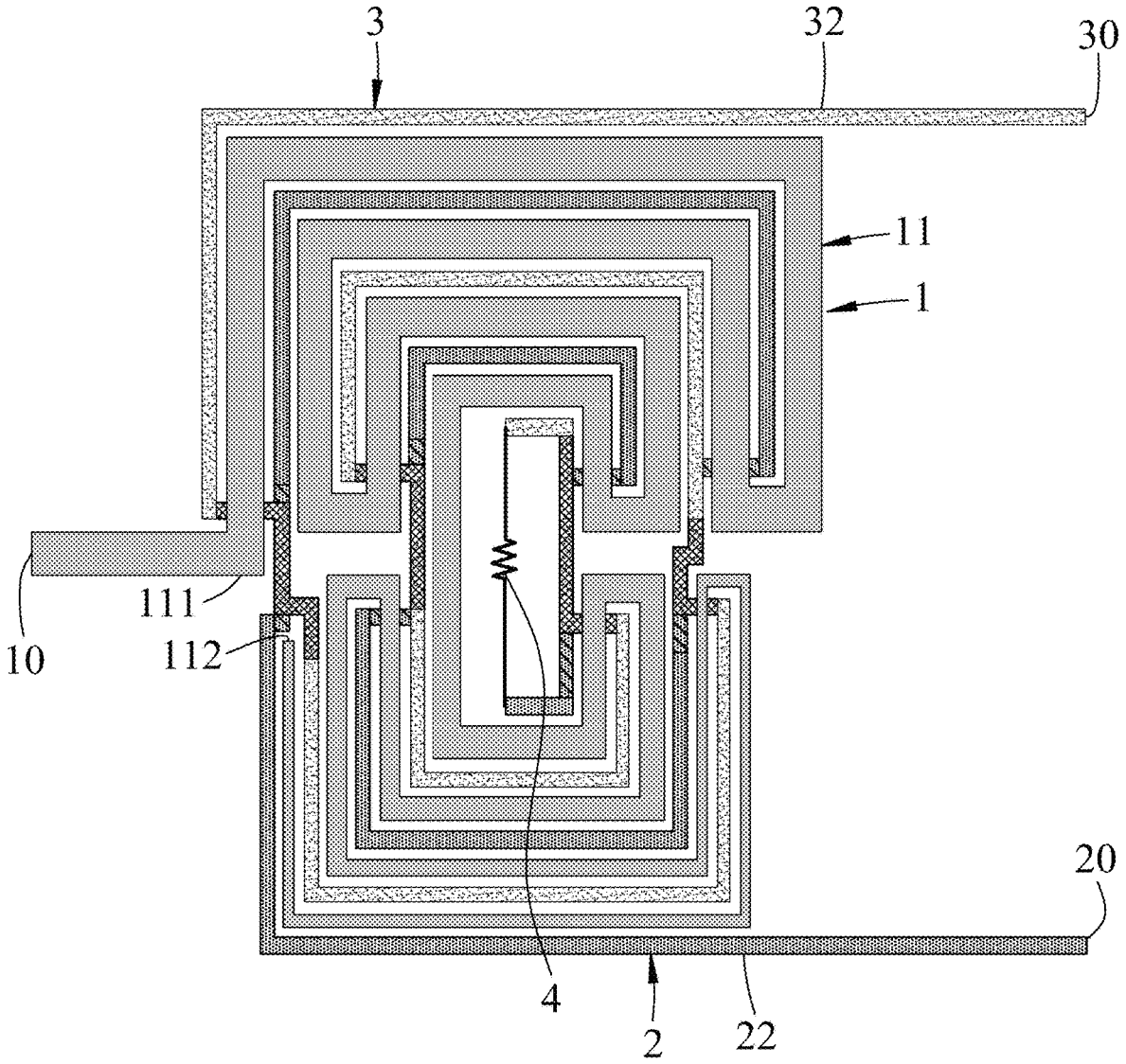
FIG. 7 is a schematic diagram that exemplarily illustrates a layout of the another power divider/combiner according to an embodiment of the disclosure.

FIG. 7 exemplarily Illustrates a layout of the second power divider/combiner according to an embodiment of the disclosure that utilizes 0.18 μm CMOS technology, wherein segments of conductors that are filled with slashes, segments of conductors that are filled with grids, and segments of conductors that are not filled with slashes or grids are to be positioned at different layers. In the implementation shown in FIG. 7, the width of the first part 11 of the first transmission line 1 is gradually narrower from the first end 111 to the second end 112. The second transmission line 2 and the third transmission line 3 are of a same and uniform width. As can be seen in FIG. 7, the second transmission line 2 and the third transmission line 3 are each arranged generally as a spiral, and the first part 11 is disposed between the second transmission line 2 and the third transmission line 3 and has a general shape that is composed by two horseshoe-shaped spirals that face each other. The first part 11 of the first transmission line 1 is substantially uniformly spaced from the second transmission line 2 and from the third transmission line 3.

In an embodiment that utilizes the layout of FIG. 7 and that is designed for 28 GHz operation (that is, being operated with input signals having the frequency of 28 GHz), the width of the first part 11 of the first transmission line 1 is 8 μm at the first end 111 and 3 μm at the second end 112, the width of each of the second transmission line 2 and the third transmission line 3 is 3 μm, and the intervals between the first part 11 and each of the second transmission line 2 and the third transmission line 3 is 2 μm. The power divider/combiner of said embodiment has a width of 131 μm and a length of 152 μm, which yield an area of 0.02 $mm^2$, which is significantly small in comparison with a conventional Wilkinson power divider/combiner that has an area of 0.116 $mm^2$. Further, as mentioned above with respect to FIG. 1, the resistor 4 helps to improve S-parameters $S_{32}$, $S_{22}$ and $S_{33}$, so that these S-parameters of the disclosed power combiner/divider have values close to the ideal value of zero. In addition, the tapering width of the first part 11 of the first transmission line 1 reduces overall power loss of the disclosed power combiner/divider, and offers more degrees of freedom in designing the power divider/combiner.

Figure 8:
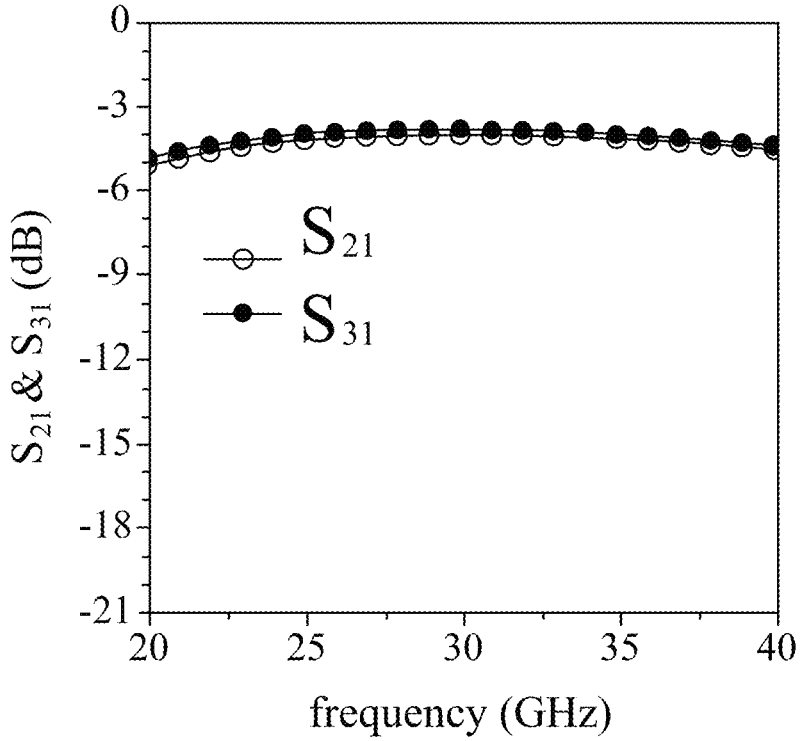
FIG. 8 is a chart that exemplarily illustrates two S-parameters associated with the another power divider/combiner according to an embodiment of the disclosure.
Figure 9:
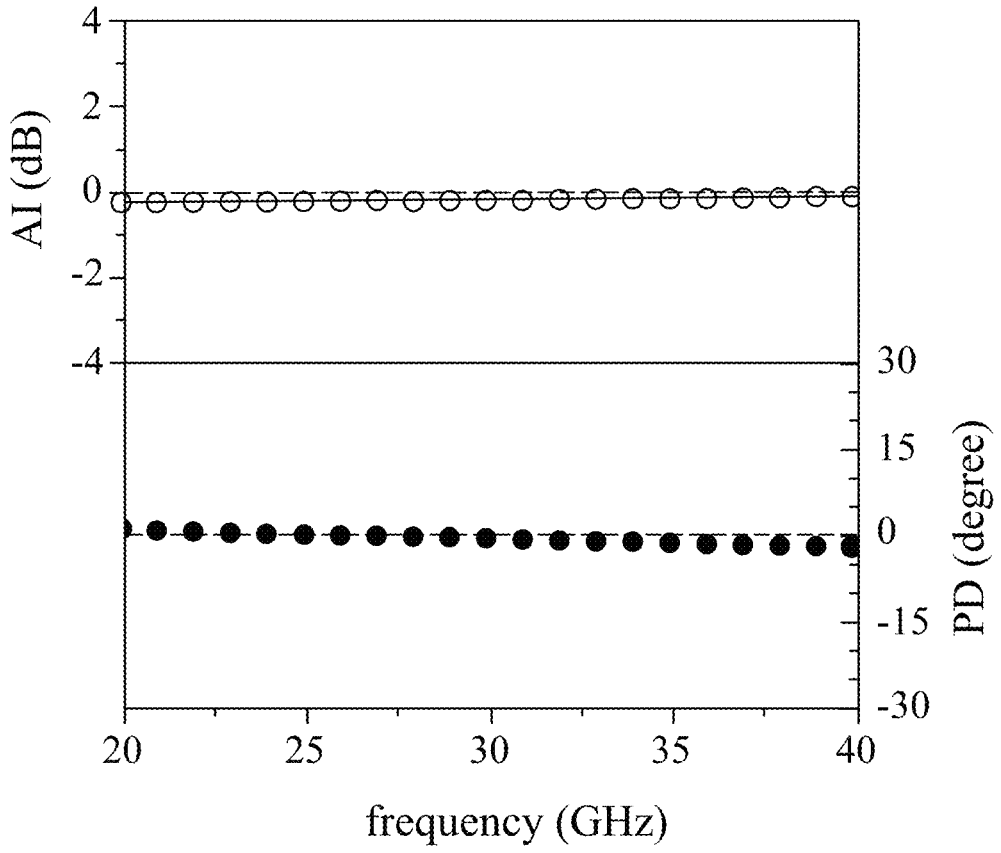
FIG. 9 is a chart that exemplarily illustrates amplitude imbalance and phase difference between the two S-parameters associated with the another power divider/combiner according to an embodiment of the disclosure.

FIG. 8 is a chart that exemplarily illustrates S-parameters $S_{21}$ and $S_{31}$ (in dB) that are simulated with respect to the second power divider/combiner shown in FIG. 7 when operated at 20 GHz to 40 GHz, wherein the S-parameter $S_{21}$ is related to signals from the first port 10 to the second port 20, and the S-parameter $S_{31}$ is related to signals from the first port 10 to the third port 30. It can be seen that the values of the S-parameters $S_{21}$ and $S_{31}$ in the chart are very close to the ideal value of −3 dB, which means that the disclosed power divider/combiner does not suffer from significant power loss. Amplitude imbalance (AI) and phase difference (PD) between said S-parameters $S_{21}$ and $S_{31}$ are shown in FIG. 9, wherein AI=$S_{21}$(dB)−$S_{31}$(dB), and PD=$S_{21}$(degree)−$S_{31}$(degree). It can be seen that the values of AI thus derived are close to the ideal value of 0 dB, and the values of PD thus derived are close to the ideal value of 0'.

The first and second power dividers/combiners as described above are beneficial in the aspects of having small device area and low production cost. In addition, by utilizing the resistor 4 between the second transmission line 2 and the third transmission line 3 to increase isolation between the second port 20 and the third port 30, the S-parameters $S_{32}$, $S_{22}$ and $S_{33}$ associated with the disclosed power dividers/combiners are all close to the ideal value of zero. Further, the tapering width of the first transmission line 1 (in the second power divider/combiner), the second transmission line 2 (in the first power divider/combiner) or the third transmission line 3 (in the first power divider/combiner) reduces power loss and offers more degrees of freedom in design.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A power divider/combiner, comprising:

a first transmission line that includes a first part and a second part which are of a same particular length, each of said first part and said second part having a first end and a second end, said second end of said first part being connected to said first end of said second part, said first end of said first part being connected to a first port, said second end of said second part being grounded;

a second transmission line of the particular length, said second transmission line being disposed in the vicinity of said first transmission line without contacting said first transmission line so that said second transmission line is electromagnetically coupled with said first transmission line, said second transmission line having a first end and a second end, said second end of said second transmission line being connected to a second port; and a third transmission line of the particular length, said third transmission line being disposed in the vicinity of said first transmission line without contacting said first transmission line so that said third transmission line is electromagnetically coupled with said first transmission line, said third transmission line having a first end and a second end, said second end of said third transmission line being connected to a third port, wherein said first transmission line, said second transmission line and said third transmission line are configured such that when an input signal that has a target wavelength equal to four times the particular length is received at the first port, a pair of output signals that are in-phase with each other and that each have the target wavelength are outputted respectively at the second port and the third port, and when a pair of input signals that are in-phase with each other and that each have the target wavelength are received respectively at the second port and the third port, an output signal that has the target wavelength is outputted at the first port.

2. The power divider of claim 1, further comprising:

a resistor connected between said first end of said second transmission line and said first end of said third transmission line.

3. The power divider of claim 2, wherein said resistor is configured to have a middle point that is equivalent to open circuit.

4. The power divider of claim 2, wherein said resistor has an electrical resistance that is between 25Ω and 100Ω.

5. The power divider of claim 1, wherein:

said second transmission line is disposed in the vicinity of said first part of said first transmission line so that said second transmission line is electromagnetically coupled with said first part, said second end of said second transmission line being disposed near said second end of said first part; and said third transmission line is disposed in the vicinity of said second part of said first transmission line so that said third transmission line is electromagnetically coupled with said second part, said second end of said third transmission line being disposed near said first end of said second part.

6. The power divider of claim 5, wherein:

said first part and said second part of said first transmission line are of a same and uniform width;

the width of said second transmission line is gradually narrower from said second end to said first end of said second transmission line; and the width of said third transmission line is gradually narrower from said second end to said first end of said third transmission line.

7. The power divider of claim 5, wherein:

said first part of said first transmission line, said second part of said first transmission line, said second transmission line and said third transmission line are each arranged substantially as a square spiral.

8. The power divider of claim 5, wherein:

said second transmission line is substantially uniformly spaced from said first part of said first transmission line, and said third transmission line is substantially uniformly spaced from said second part of said first transmission line.

9. The power divider of claim 1, wherein:

said second transmission line and said third transmission line are both disposed in the vicinity of said first part of said first transmission line so that said second transmission line and said third transmission line are both electromagnetically coupled with said first part, said second transmission line and said third transmission line being each substantially uniformly spaced from said first part of said the first transmission line, both of said first end of said second transmission line and said first end of said third transmission line being disposed near said first end of said first part, both of said second end of said second transmission line and said second end of said third transmission line being disposed near said second end of said first part.

10. The power divider of claim 9, wherein:

the width of said first part of said first transmission line is gradually narrower from said first end to said second end of said first part; and said second transmission line and said third transmission line are of a same and uniform width.

11. The power divider of claim 9, wherein:

said second transmission line and said third transmission line are each arranged as a spiral, and said first part of said first transmission line has a shape that is composed by two horseshoe-shaped spirals.

12. The power divider of claim 9, wherein said first part of said first transmission line is disposed between said second transmission line and said third transmission line.

* * * * *